US012648681B2

(12) United States Patent
Terrádez Alemany et al.

(10) Patent No.: US 12,648,681 B2
(45) Date of Patent: Jun. 9, 2026

(54) SYSTEM COMPRISING A DISHWASHER, AND METHOD FOR OPERATING A DISHWASHER

(71) Applicant: BSH Hausgeräte GmbH, Munich (DE)

(72) Inventors: Maria Terrádez Alemany, Munich (DE); Berkay Ogulcan Tutal, Munich (DE)

(73) Assignee: BSH Hausgeräte GmbH, Munich (DE)

( * ) Notice: Subject to any disclaimer, the term of this patent is extended or adjusted under 35 U.S.C. 154(b) by 38 days.

(21) Appl. No.: 17/790,965

(22) PCT Filed: Feb. 10, 2021

(86) PCT No.: PCT/EP2021/053146
§ 371 (c)(1),
(2) Date: Jul. 6, 2022

(87) PCT Pub. No.: WO2021/170405
PCT Pub. Date: Sep. 2, 2021

(65) Prior Publication Data

US 2023/0012891 A1 Jan. 19, 2023

(30) Foreign Application Priority Data

Feb. 27, 2020 (DE) ..... 102020202501

(51) Int. Cl.
*A47L 15/42* (2006.01)
*A47L 15/00* (2006.01)
*A47L 15/46* (2006.01)

(52) U.S. Cl.
CPC ..... *A47L 15/4295* (2013.01); *A47L 15/0021* (2013.01); *A47L 15/4278* (2013.01);
(Continued)

(58) Field of Classification Search
None
See application file for complete search history.

(56) References Cited

U.S. PATENT DOCUMENTS

2005/0011544 A1 1/2005 Rosenbauer
2008/0276976 A1* 11/2008 Buller ..... A47L 15/4293 345/173

(Continued)

FOREIGN PATENT DOCUMENTS

CN 109793469 A 5/2019
DE 10048081 A1 4/2002

(Continued)

OTHER PUBLICATIONS

National Search Report DE 10 2020 202 501 dated Feb. 2, 2021.

(Continued)

*Primary Examiner* — Kaj K Olsen
*Assistant Examiner* — Pradhuman Parihar
(74) *Attorney, Agent, or Firm* — Michael E. Tschupp; Andre Pallapies; Brandon G. Braun

(57) ABSTRACT

A system includes a dishwasher accommodating an item to be washed, a control device carrying out a washing program of a number of washing programs for washing the item, an optical sensor acquiring an optical sensor signal of the item, and a determining unit determining a possibility for washing the item as a function of the acquired sensor signal. The possibility for washing is embodied as a first positive possibility for washing that specifies which one of the washing programs is useable to wash the item, or as a second positive possibility for washing that specifies which one of the washing programs and/or which of a number of aids are useable to wash the item, or as a negative possibility for washing that specifies that the dishwasher is unsuitable for washing the item. An output unit outputs a recommendation to a user based on the possibility being determined for washing.

11 Claims, 3 Drawing Sheets

(52) U.S. Cl.
CPC ..... *A47L 15/46* (2013.01); *A47L 2401/04* (2013.01); *A47L 2501/30* (2013.01)

(56) References Cited

U.S. PATENT DOCUMENTS

| | | | | |
|---|---|---|---|---|
| 2012/0060875 | A1 | 3/2012 | Fauth | |
| 2016/0049781 | A1 | 2/2016 | Nisslbeck | |
| 2017/0265706 | A1* | 9/2017 | Koven | A47L 15/0063 |
| 2018/0206695 | A1* | 7/2018 | Disch | A47L 15/4248 |
| 2018/0214001 | A1* | 8/2018 | Wobkemeier | A47L 15/4295 |
| 2019/0045998 | A1* | 2/2019 | Calvimontes | A47L 15/4276 |
| 2020/0093347 | A1* | 3/2020 | Shashidhar | A47L 15/449 |
| 2020/0138261 | A1 | 5/2020 | Terrádez Alemany | |
| 2020/0138263 | A1* | 5/2020 | Terrádez Alemany | A47L 15/0034 |

FOREIGN PATENT DOCUMENTS

| | | | |
|---|---|---|---|
| DE | 102011087227 | A1 | 5/2013 |
| DE | 102017118023 | A1 | 2/2019 |
| EP | 2932337 | B1 | 6/2021 |
| WO | 2013079380 | A2 | 6/2013 |

OTHER PUBLICATIONS

International Search Report PCT/EP2021/053146 dated Mar. 8, 2021.
National Search Report CN 2021800174228 dated Feb. 5, 2025.

* cited by examiner

SYSTEM COMPRISING A DISHWASHER, AND METHOD FOR OPERATING A DISHWASHER

CROSS-REFERENCES TO RELATED APPLICATIONS

This application is the U.S. National Stage of International Application No. PCT/EP2021/053146, filed Feb. 10, 2021, which designated the United States and has been published as International Publication No. WO 2021/170405 A1 and which claims the priority of German Patent Application, Serial No. 10 2020 202 501.0, filed Feb. 27, 2020, pursuant to 35 U.S.C. 119(a)-(d).

The contents of International Application No. PCT/EP2021/053146 and German Patent Application, Serial No. 10 2020 202 501.0 are incorporated herein by reference in their entireties as if fully set forth herein.

BACKGROUND OF THE INVENTION

The present invention relates to a system with a dishwasher, such as for example a household dishwasher, and to a method for operating a dishwasher.

A household dishwasher sometimes comprises a dishwasher cavity, which can be closed off by a door, with a number of receptacles for items to be washed for accommodating items to be washed, and a control device for carrying out one of a number of washing programs for washing items to be washed.

The user only receives assistance with loading the dishwasher cavity's receptacles for items to be washed from the printed operating guide to the dishwasher, from the printed manual for the dishwasher, or from training videos on the internet. However, this is all very laborious for the user and generally is not used either.

The user also conventionally receives no guidance if they wish to place a certain item to be washed—for example an item of cutlery or dishware made of silver, aluminum, copper, tin or wood—into the dishwasher that is in fact unsuitable for cleaning using the dishwasher. Items of cutlery or dishware made of these materials should preferably be cleaned manually.

Furthermore, the user conventionally also receives no guidance regarding the suitable use of aids in a particular situation, such as a holder in the dishwasher cavity for holding a yoghurt pot. A yoghurt pot placed without a holder in one of the receptacles for items to be washed may rotate during the course of the washing program and fill with washing liquor. This diminishes or prevents the step of drying the items to be washed in the dishwasher. In light of the above, a sub-optimal loading of the dishwasher cavity by the user may occur due to this conventional lack of guidance in particular.

Due to the sub-optimal loading of the dishwasher cavity, a sub-optimal cleaning result, a sub-optimal drying result and/or an increased energy consumption may occur.

Conventional solutions are known from US 2018/0214001 A1, DE 10 2011 087 227 A1, DE 10 048 081 A1, DE 10 2012 223 243 A1 and US 2012/0060875 A1.

BRIEF SUMMARY OF THE INVENTION

Against this background, an object of the present invention consists in further improving the operation of a dishwasher.

According to a first aspect, a system is proposed with a dishwasher, in particular a household dishwasher, having a dishwasher cavity, which can be closed off by a door, with a number of receptacles for items to be washed for accommodating items to be washed, and a control device for carrying out one of a number of washing programs for washing items to be washed, with an optical sensor for acquiring an optical sensor signal of a certain item to be washed, with a determining unit for determining a possibility for washing the certain item to be washed by the dishwasher as a function of the acquired sensor signal, wherein the possibility for washing is embodied as a first positive possibility for washing that specifies which one(s) of the washing programs may be used to wash the certain item to be washed, is embodied as a second positive possibility for washing that specifies which one(s) of the washing programs and/or which of a number of aids may be used to wash the certain item to be washed, or is embodied as a negative possibility for washing that specifies that the dishwasher is unsuitable for washing the certain item to be washed, and with an output unit for outputting a recommendation to the user based on the possibility for washing determined.

The second positive possibility for washing preferably specifies which one(s) of the washing programs and additionally which of a number of aids may be used to wash the certain item to be washed.

The output unit comprises in particular a visual and/or aural output. For example, the output unit comprises a screen and/or a loudspeaker. In this context, the output unit may be configured to use an augmented reality representation or a virtual reality representation for outputting the recommendation to the user.

In the present system, as a function of the item currently to be washed as acquired by the optical sensor signal, a corresponding possibility for washing is determined, namely the first positive possibility for washing, the second possibility for washing or the negative possibility for washing, and a corresponding recommendation is output to the user as a function of the possibility for washing determined.

For example, if the item to be washed is a wine glass or several wine glasses, by means of the optical sensor, the determining unit and the output unit, the user may be recommended to select a glass washing program. The user can select the recommended glass washing program by means of a corresponding user input and the control device then carries out the selected glass washing program for the wine glasses. In this way, the operation of the dishwasher is optimized. Furthermore, the user is advantageously confident that they have selected the correct washing program for their wine glasses. This increased confidence also increases operating convenience for the user.

The operation of the dishwasher is improved by the recommendation generated automatically for the user. The recommendation generated automatically and output to the user helps the user to load the dishwasher optimally, and to do so as a function of the respective item currently to be washed that the user wishes to load into the dishwasher. Optimal loading of the dishwasher produces an optimized cleaning result, an optimized drying result and an optimization of the energy consumption.

The control device can be implemented as hardware and/or software. The control device is in particular integrated into the dishwasher. Alternatively, the control device can also be arranged outside the dishwasher. If implemented as hardware, the control device can be embodied for example as a computer or microprocessor. If implemented as software, the control device can be embodied as a computer program product, as a function, as a routine, as part of a program code or as an executable object.

The control device is configured to carry out one washing program of a number of washing programs for washing the items to be washed. A washing program comprises for example different program sub-steps, such as a pre-rinse, a cleaning, a rinsing and/or a drying. Different washing programs differ for example with regard to a sequence and/or type of program sub-steps and with regard to different operating parameters, such as for example a duration and/or washing liquor temperature of one or several program sub-steps.

Items to be washed are arranged in the washing compartment, in particular on one or several receptacles for items to be washed, for washing with the household dishwasher. The items to be washed comprise in particular various items of dishware, cutlery and/or tools which are used for preparing, storing and/or consuming foods. These are for example plates, pots, cups, knives, glasses, bowls and the like.

According to one embodiment, in the event of the negative possibility for washing being determined, the determining unit is further configured additionally to determine a recommendation for an alternative cleaning of the certain item to be washed, wherein the output unit is configured to output the recommendation for the alternative cleaning.

In the event of the negative possibility for washing, the certain item to be washed cannot be washed with the present dishwasher or cannot be washed satisfactorily with the present dishwasher. The output unit consequently outputs to the user a recommendation for or guidance regarding an alternative cleaning.

According to a further embodiment, the recommendation for an alternative cleaning comprises a manual cleaning of the certain item to be washed. In this case, for example, the use of a certain cleaning product or also a certain cleaning cloth, for example a cleaning cloth for silver, may be recommended for the certain item to be washed.

According to a further embodiment, the number of aids comprises a number of additional functions, for example a glass washing program.

According to a further embodiment, in the event of the second positive possibility for washing being determined, the determining unit is configured to select at least one certain additional function out of the number of additional functions as a function of the optical sensor signal acquired. In this context, the output unit is configured to output to the user a recommendation to use the at least one selected additional function.

According to a further embodiment, the number of aids comprises a number of accessories comprising at least a holder for holding an item to be washed out of a certain first type of items to be washed and/or at least a placement area for placing an item to be washed out of a certain second type of items to be washed.

For example, a yoghurt pot can be an example of an item to be washed out of the certain first type of items to be washed. Because of its low empty weight, and due to the spray jets striking it, a yoghurt pot tends to rotate during the course of the washing program and fill with washing liquor. In this case, it may be recommended to place the yoghurt pot in a holder within the dishwasher cavity for items to be washed so that said yoghurt pot cannot rotate and fill with washing liquor during the course of the washing program. A red wine glass, for example, can be an item to be washed out of the certain second type of items to be washed. There are specific placement areas for red wine glasses for the dishwasher cavity for items to be washed, the use of which may be recommended to the user by means of the output unit.

According to a further embodiment, in the event of the second positive possibility for washing being determined, the determining unit is configured to select at least one of the accessories as a function of the optical sensor signal acquired. In this context, the output unit is configured to output to the user a recommendation to use the at least one selected accessory.

According to a further embodiment, the number of aids comprises a number of spray facilities. In particular, the number of spray facilities comprises one or more spray arms and/or special nozzles.

By means of a corresponding user input, the user can then select the recommended aid and the selected aid can be activated by the control device during the course of the washing program.

According to a further embodiment, in the event of the second positive possibility for washing being determined, the determining unit is configured to select at least one of the special nozzles as a function of the optical sensor signal acquired, wherein the output unit is configured to output to the user a recommendation to use the at least one selected special nozzle.

According to a further embodiment, the optical sensor comprises a camera, wherein the optical sensor signal comprises an image and/or a video of the dishwasher cavity.

According to a further embodiment, the dishwasher integrates the optical sensor, the determining unit and the output unit.

According to a further embodiment, the system has a device that is external to the dishwasher and integrates at least the optical sensor.

According to a further embodiment, the external device integrates the optical sensor and the determining unit.

According to a further embodiment, the external device integrates the optical sensor and the output unit.

According to a further embodiment, the external device integrates the optical sensor, the determining unit and the output unit.

According to a further embodiment, the determining unit and the output unit are embodied as part of an app that may be installed on the external device.

The external device is in particular a mobile device. The mobile device is for example a smartphone, a tablet or a tablet computer. The app can also be referred to as application, application software or application program. The app can be embodied in particular as a program, as a computer program, as software, as a computer program product, as a function, as a routine, as part of a program code or as an executable object.

The dishwasher comprises in particular a communication unit, which can be connected for example by means of a network to the external device and thus to the app installed on the external device. Here, the network comprises in particular a mobile radio network, a WLAN and/or a further wireless or wired data network.

According to a further embodiment, the output unit is configured to use an augmented reality representation or a virtual reality representation for outputting the recommendation to the user.

For example, if the output unit is embodied on a user's smartphone or tablet, a virtual reality representation is particularly suitable for guiding the user optimally in loading the dishwasher. If, for example, the output unit is integrated on AR glasses, the augmented reality representation is particularly advantageous for supporting the user in loading the dishwasher.

According to a second aspect, a system is proposed for a dishwasher, in particular a household dishwasher, with a dishwasher cavity, which can be closed off by a door, with a number of receptacles for items to be washed for accommodating items to be washed, and with a control device for carrying out one of a number of washing programs for washing items to be washed. In this context, the system comprises an optical sensor for acquiring an optical sensor signal of a certain item to be washed, a determining unit for determining a possibility for washing the certain item to be washed by the dishwasher as a function of the acquired sensor signal, wherein the possibility for washing is embodied as a first positive possibility for washing that specifies which one(s) of the washing programs may be used to wash the certain item to be washed, is embodied as a second positive possibility for washing that specifies which one(s) of the washing programs and/or which of a number of aids may be used to wash the certain item to be washed, or is embodied as a negative possibility for washing that specifies that the dishwasher is unsuitable for washing the certain item to be washed, and has an output unit for outputting a recommendation to the user based on the possibility for washing determined.

According to a third aspect, a method is proposed for operating a dishwasher, in particular a household dishwasher, with a dishwasher cavity, which can be closed off by a door, with a number of receptacles for items to be washed for accommodating items to be washed, and with a control device for carrying out one of a number of washing programs for washing items to be washed. The method comprises the following steps:

acquiring by means of an optical sensor an optical sensor signal of a certain item to be washed, determining a possibility for washing the certain item to be washed by the dishwasher as a function of the acquired sensor signal, wherein the possibility for washing is embodied as a first positive possibility for washing that specifies which one(s) of the washing programs may be used to wash the certain item to be washed, is embodied as a second positive possibility for washing that specifies which one(s) of the washing programs and/or which of a number of aids may be used to wash the certain item to be washed, or is embodied as a negative possibility for washing that specifies that the dishwasher is unsuitable for washing the certain item to be washed, and outputting a recommendation to the user based on the possibility for washing determined.

The second positive possibility for washing preferably specifies which one(s) of the washing programs and additionally which of a number of aids may be used to wash the certain item to be washed.

The embodiments and features described for the proposed system apply correspondingly to the proposed method.

According to a fourth aspect, a computer program product is proposed which initiates the execution of the method as described above on a program-controlled device.

A computer program product, such as a computer program means, can for example be provided or supplied as a storage medium such as a memory card, USB stick, CD-ROM or DVD or also in the form of a file which can be downloaded from a server in a network. This can take place, for example, in a wireless communications network through the transmission of a corresponding file with the computer program product or the computer program means.

Further possible implementations of the invention also comprise combinations—not explicitly cited—of features or embodiments described above or below in respect of the exemplary embodiments. In this context, the person skilled in the art will also add individual aspects as improvements or enhancements to the respective basic form of the invention.

BRIEF DESCRIPTION OF THE DRAWINGS

Further advantageous embodiments and aspects of the invention form the subject matter of the subclaims and of the exemplary embodiments of the invention that are described below. The invention is described below in greater detail on the basis of preferred embodiments with reference to the attached figures.

DETAILED DESCRIPTION OF EXEMPLARY EMBODIMENTS OF THE PRESENT INVENTION

Figure 1:
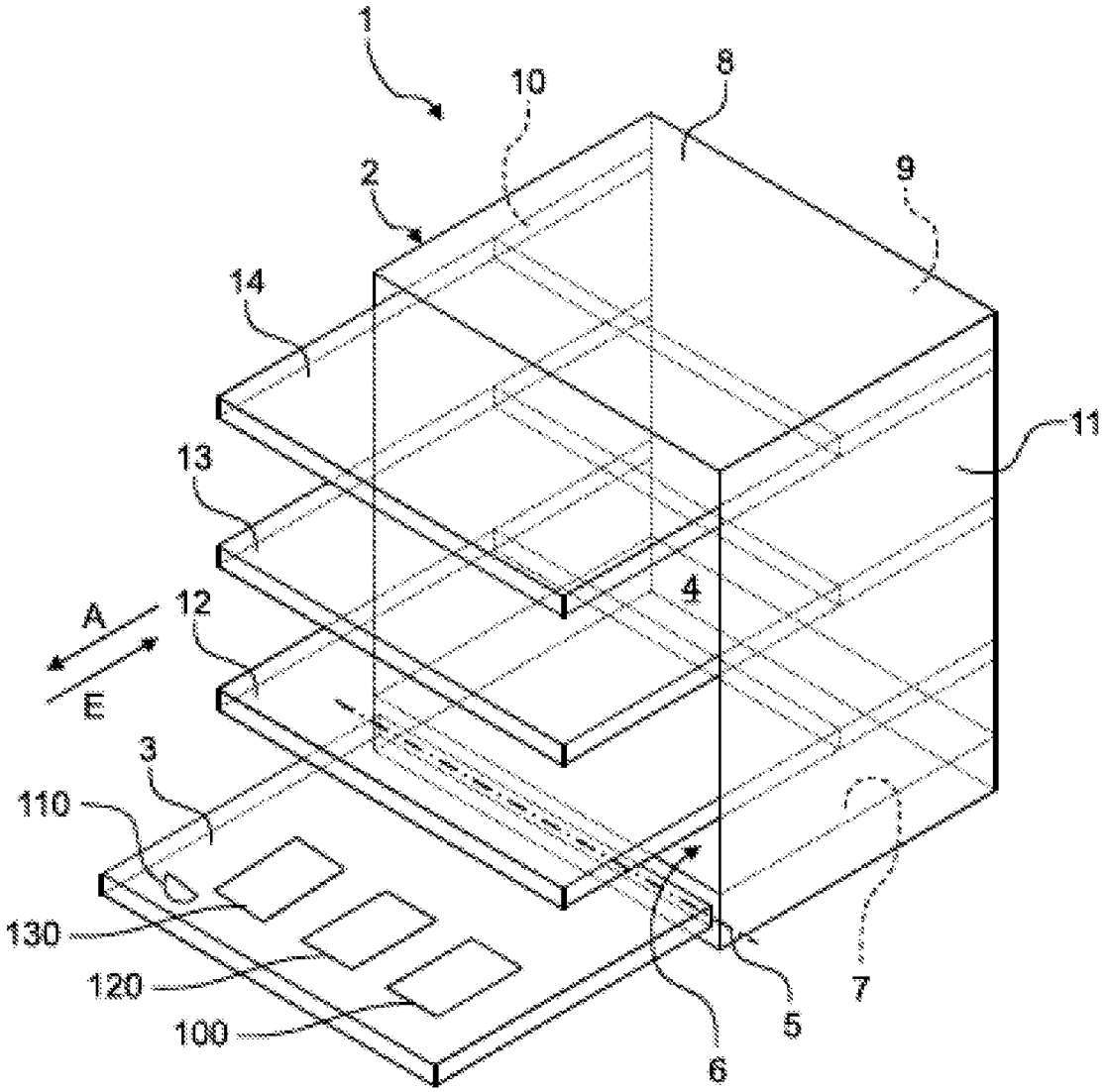
FIG. 1 shows a schematic perspective view of an exemplary embodiment of a system with a household dishwasher.

In the figures, elements that are identical or have the same function are provided with the same reference characters unless specified otherwise.

FIG. 1 shows a schematic perspective view of an exemplary embodiment of a system with a household dishwasher 1. The household dishwasher 1 comprises a dishwasher cavity 2, which can be closed off by a door 3, in particular in a watertight manner. A sealing facility (not shown) may be provided for this purpose between the door 3 and the dishwasher cavity 2. The dishwasher cavity 2 is preferably cuboid in shape. The dishwasher cavity 2 can be arranged in a housing of the household dishwasher 1. The dishwasher cavity 2 and the door 3 can form a washing compartment 4 for washing items to be washed.

The door 3 is shown in its open position in FIG. 1. The door 3 may be closed or opened by pivoting about a pivot axis 5 provided at a lower end of the door 3. With the aid of the door 3, a loading opening 6 of the dishwasher cavity 2 can be closed or opened. The dishwasher cavity 2 has a bottom 7, a ceiling 8 arranged opposite the bottom 7, a rear wall 9 arranged opposite the closed door 3 and two side walls 10, 11 arranged opposite one another. The bottom 7, the ceiling 8, the rear wall 9 and the side walls 10, 11 can be manufactured from a stainless steel sheet, for example. Alternatively, the bottom 7 can be manufactured from a plastic material, for example.

Furthermore, the household dishwasher 1 has at least one receptacle 12, 13, 14 for items to be washed. Preferably, a plurality of receptacles 12, 13, 14 for items to be washed, for example three, can be provided, wherein the receptacle 12 for items to be washed can be a lower receptacle for items to be washed or a lower basket, the receptacle 13 for items to be washed can be an upper receptacle for items to be washed or an upper basket, and the receptacle 14 for items to be washed can be a cutlery drawer. As additionally shown in FIG. 1, the receptacles 12, 13, 14 for items to be washed are arranged one above the other in the dishwasher cavity 2. Each receptacle 12, 13, 14 for items to be washed is optionally able to be shifted into or out of the dishwasher cavity 2. In particular, each receptacle 12, 13, 14 for items to be washed is able to be inserted into the dishwasher cavity 2 in an insertion direction E and extracted from the dishwasher cavity 2 in an extraction direction A opposite to the insertion direction E.

An optical sensor 110 embodied as a camera is arranged on the door 3, so that it is configured for acquiring an optical sensor signal of a certain item to be washed that may be introduced into the dishwasher cavity 2.

The optical sensor 110 may also be arranged at another position on the dishwasher 1, for example on an outer shell of the dishwasher 1. Here, the optical sensor 110 is arranged in particular so that it can take an image of an item to be washed that the user standing in front of the dishwasher is holding in their hands.

The household dishwasher 1 also has a control device 100, a determining unit 120 and an output unit 130, which are arranged on the door 3.

The control device 100 is configured to carry out one washing program of a number of washing programs for washing items to be washed in the dishwasher cavity 2.

The determining unit 120 is configured to determine a possibility for washing the certain item to be washed by the dishwasher 1 as a function of the acquired sensor signal. Here, the possibility for washing is embodied as a first positive possibility for washing, as a second possibility for washing or as a negative possibility for washing.

The first positive possibility for washing specifies which one(s) of the washing programs may be used to wash the certain item to be washed.

The second positive possibility for washing specifies which one(s) of the washing programs and/or which of a number of aids may be used to wash the certain item to be washed. In particular, the second positive possibility for washing specifies which one(s) of the washing programs and additionally which of the number of aids may be used to wash the certain item to be washed.

Conversely, the negative possibility for washing specifies that the dishwasher 1 is unsuitable for washing the certain item to be washed. Consequently the certain item to be washed cannot be washed with the present dishwasher 1 or cannot be washed satisfactorily with the present dishwasher 1.

The output unit 130 is configured for outputting a recommendation to the user based on the possibility for washing determined. For example, if the determining unit 120 determines the first positive possibility for washing, the output unit 130 outputs to the user a recommendation for the washing program to be used. By means of a user input, the user can then select the recommended washing program and the control device 100 then carries out this selected washing program.

If the determining unit 120 determines the second positive possibility for washing, the output unit 130 outputs for example a recommendation for a washing program and additionally an aid for washing the certain item to be washed. By means of a corresponding user input, the user can then select the recommended washing program and/or the recommended aid, which will then be carried out by the control device 100.

For example, if the proposed aid is one or more special nozzles of the dishwasher cavity 2, the user can select these by means of their user input and the control device 100 then activates these special nozzles during the course of the selected washing program. Generally speaking, in the event of the second positive possibility for washing being determined, the determining unit 120 can be configured to select at least one of the special nozzles as a function of the optical sensor signal acquired, wherein the output unit 130 then outputs to the user a recommendation to use this at least one selected special nozzle.

However, if the determining unit 120 determines the negative possibility for washing the certain item to be washed, it can additionally determine a recommendation for an alternative cleaning of the certain item to be washed. In this context, the output unit 130 is then configured to output to the user a recommendation for the alternative cleaning of this certain item to be washed. The alternative cleaning may be manual cleaning, for example by means of a certain cleaning cloth. Furthermore, the number of aids may also comprise a number of additional functions, e.g. a special glass washing program.

In this context, in the event of the second positive possibility for washing being determined, the determining unit 120 is preferably configured to select at least one certain additional function out of the number of additional functions as a function of the optical sensor signal acquired. The output unit 130 can then output to the user a recommendation to use the at least one selected additional function. By means of a corresponding user input, the user can select or not select the recommended additional function.

Furthermore, the number of aids may also comprise various accessories. Examples of accessories include a holder for holding an item to be washed out of a certain first type of items to be washed and a placement area for placing an item to be washed out of a certain second type of items to be washed. A yoghurt pot, for example, is an example of an item to be washed out of a certain first type of items to be washed. Here, it may be recommended to place the yoghurt pot in a holder within the dishwasher cavity 2 for items to be washed so that said yoghurt pot does not rotate and cannot fill with washing liquor during the course of the washing program. A red wine glass, for example, can be an item to be washed out of the certain second type of items to be washed. Specific placement areas then exist for red wine glasses, the use of which may be recommended to the user by means of the output unit 130.

Furthermore, in the event of the second positive possibility for washing being determined, the determining unit 110 may preferably be configured to select at least one of the accessories as a function of the optical sensor signal acquired. In this context, the output unit 130 can then output to the user a recommendation to use the at least one selected accessory. Furthermore, the number of aids may also comprise a number of spray facilities in the dishwasher cavity 2, for example a spray arm or a special nozzle.

The output unit 130 comprises in particular a visual and/or aural output. For example, the output unit 130 comprises a screen and/or a loudspeaker. The output unit 130 may also be configured to use an augmented reality representation or a virtual reality representation for outputting the recommendation to the user.

Figure 2:
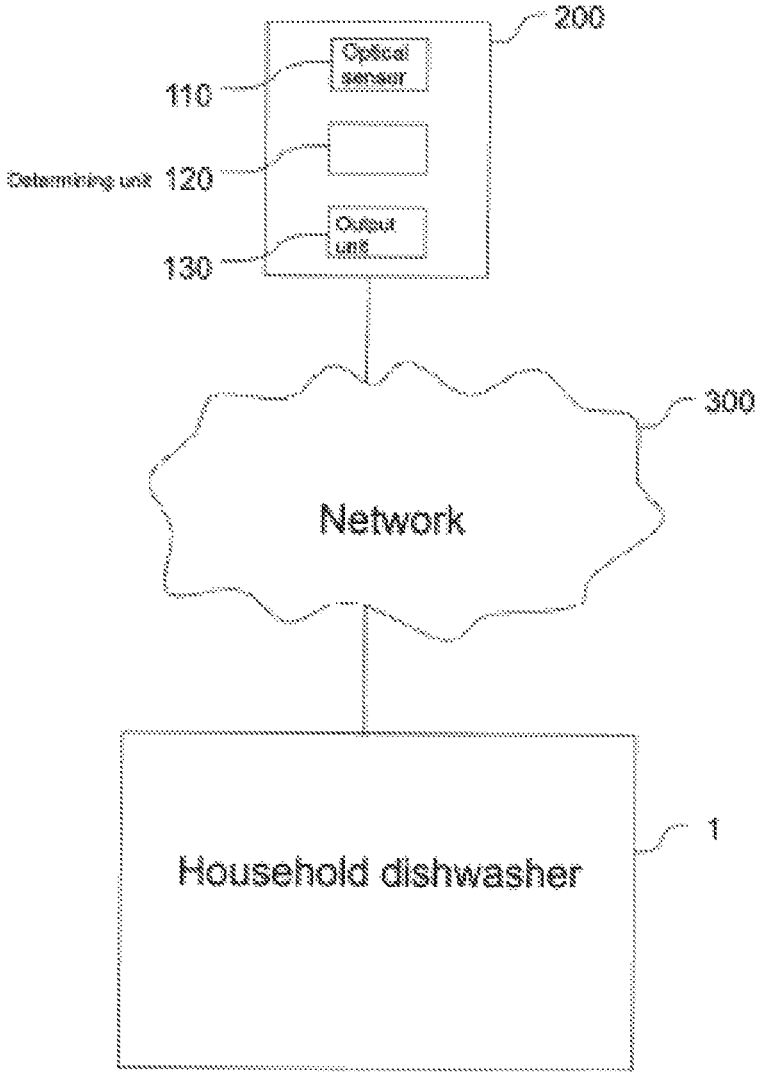
FIG. 2 shows a schematic view of a further exemplary embodiment of a system with a household dishwasher and an external device.

FIG. 2 shows a schematic view of a further exemplary embodiment of a system with a dishwasher 1 and an external device 200. The dishwasher 1 and the external device 200 may be linked via at least one network 300, for example the internet. The exemplary embodiment in FIG. 2 differs from the exemplary embodiment according to FIG. 1 in that the optical sensor 110, the determining unit 120 and the output unit 130 are integrated in the external device 200. The external device 200 is for example a smartphone or a tablet.

The optical sensor 110 is for example the camera on the smartphone or tablet. The determining unit 120 and the output unit 130 are integrated at least partly in an app that is installed and run on the external device 200, for example.

Figure 3:
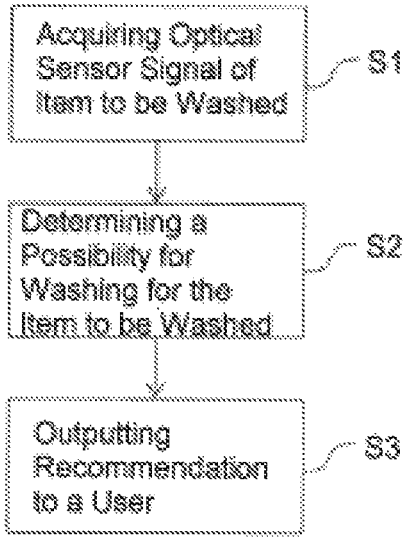
FIG. 3 shows a schematic block diagram of an exemplary embodiment of a method for operating a household dishwasher.

FIG. 3 shows a schematic block diagram of a method for operating a dishwasher 1 with a dishwasher cavity 2, which can be closed off by a door 3, with a number of receptacles 12, 13, 14 for items to be washed for accommodating items to be washed, and with a control device 100 for carrying out one of a number of washing programs for washing items to be washed. An example of a household dishwasher 1 is shown in FIG. 1. The method in FIG. 3 comprises the steps S1 to S3:

In step S1, an optical sensor signal of a certain item to be washed is acquired by means of an optical sensor 110. For example, the user standing in front of the dishwasher 1 is holding in their hands the item to be washed.

In step S2, a possibility for washing a certain item to be washed by the dishwasher 1 is determined as a function of the acquired sensor signal. The possibility for washing is embodied as a first positive possibility for washing, as a second possibility for washing or as a negative possibility for washing.

The first positive possibility for washing specifies which one(s) of the washing programs may be used to wash the certain item to be washed. The second positive possibility for washing specifies which one(s) of the washing programs and/or which of a number of aids may be used to wash the certain item to be washed. The negative possibility for washing specifies that the present dishwasher 1 is unsuitable for washing the certain item to be washed.

In step S3, a recommendation is output to the user based on the possibility for washing determined.

Although the present invention has been described with reference to exemplary embodiments, it can be modified in numerous different ways.

REFERENCE CHARACTERS USED

1 Household dishwasher
2 Dishwasher cavity
3 Door
4 Washing compartment
5 Pivot axis
6 Loading opening
7 Bottom
8 Ceiling
9 Rear wall
10 Side wall
11 Side wall
12 Receptacle for items to be washed
13 Receptacle for items to be washed
14 Receptacle for items to be washed
100 Control device
110 Optical sensor
120 Determining unit
130 Output unit
200 External device
300 Network
A Extraction direction
E Insertion direction
S1 Method step
S2 Method step
S3 Method step

What is claimed is:

1. A system, comprising: a dishwasher including a dishwasher cavity for accommodating a first item to be washed and a second item to be washed, a number of aids usable to wash the first item to be washed and the second item to be washed, and a door to close off the dishwasher cavity; a control device, the control device being a microprocessor that is integrated into the dishwasher; an optical sensor integrated into a mobile device and configured to acquire a first optical sensor signal of the first item to be washed and a second optical sensor signal of the second item to be washed, the first optical sensor signal being indicative of a type of the first item to be washed and the second optical sensor signal being indicative of a type of the second item to be washed; the mobile device configured to execute a computer program product to: receive the first optical sensor signal of the first item to be washed and the second optical signal of the second item to be washed; control, based on the type of the first item to be washed indicated by the first optical sensor signal, a visual output of a screen of the mobile device to display a selectable option representing a washing program of a number of washing programs, wherein each washing program of the number of washing programs comprises one or more program sub-steps that the control device is configured to execute in a particular sequence or according to a particular set of operating parameters, wherein the one or more program sub-steps for each washing program are selected from a group consisting of a pre-rinse sub-step, a cleaning sub-step, a rinsing sub-step, and a drying sub-step, and representing an aid of the number of aids; control, based on the type of the second item to be washed indicated by the second optical sensor signal, the visual output of the screen of the mobile device to display a non-selectable option representative of manually cleaning the second item to be washed, the non-selectable option comprising an indication of a particular cleaning product to use for the manual cleaning;

and determine, based on a third optical sensor signal of the dishwasher cavity received from the optical sensor, that the second item to be washed is removed from the dishwasher cavity; and wherein the control device is configured to: receive a user selection of the selectable option and an indication that the second item to be washed is removed from the dishwasher cavity; and in response to receiving the user selection and the indication that the second item to be washed is removed from the dishwasher cavity, control the dishwasher by causing the dishwasher to execute the washing program from the number of washing programs and by activating the aid of the number of aids of the dishwasher.

2. The system of claim 1, wherein the dishwasher is a household dishwasher.

3. The system of claim 1, wherein the washing program from the number of washing programs for washing the first item to be washed is a glass washing program.

4. The system of claim 1, wherein the computer program product is further configured to select at least one of a number of additional functions as a function of the first optical sensor signal and to output to the at least one selected additional function.

5. The system of claim 1, wherein the dishwasher further comprises a number of accessories comprising at least a holder for holding the first item to be washed, when the first item to be washed is a first type of item to be washed and/or at least a placement area for placing the first item to be washed, when the first item to be washed is a second type of item to be washed.

6. The system of claim 5, wherein the computer program product is configured to select at least one of the accessories as a function of the first optical sensor signal and to output the at least one selected accessory.

7. The system of claim 1, wherein the number of aids comprises a number of spray facilities.

8. The system of claim 7, wherein the computer program product is configured to select at least one special nozzle of the spray facilities as a function of the first optical sensor signal and to output the at least one selected special nozzle.

9. The system of claim 1, wherein the optical sensor comprises a camera, with the first optical sensor signal comprising an image and/or a video of the first item to be washed.

10. A method for operating a dishwasher comprising a control device and a dishwasher cavity for accommodating a first item to be washed and a second item to be washed, wherein the control device is a microprocessor that is integrated into the dishwasher; said method comprising: receiving, by a computer program product executing on a mobile device, a first optical sensor signal of the first item to be washed and a second optical sensor signal of the second item to be washed from an optical sensor, the first optical sensor signal being indicative of a type of the first item to be washed and the second optical sensor signal being indicative of a type of second item to be washed, and the optical sensor is integrated into the mobile device; controlling by the computer product and based on the type of the first item to be washed indicated by the first optical sensor signal, a visual output of a screen of the mobile device to display a selectable option representing a washing program of a number of washing programs, wherein each washing program of the number of washing programs comprises one or more program sub-steps that the control device is configured to execute in a particular sequence or according to a particular set of operating parameters, wherein the one or more program sub-steps for each washing program are selected from a group consisting of a pre-rinse sub-step, a cleaning sub-step, a rinsing sub-step, and a drying sub-step, and representing an aid of a number of aids of the dishwasher that are usable to wash the first item to be washed; controlling, based on the type of the second item to be washed indicated by the second optical sensor signal, the visual output of the screen of the mobile device to display a non-selectable option to manually clean the second item to be washed with a particular cleaning product and an indication that the second item to be washed is removed from the dishwasher cavity; receiving, by the control device, a user selection of the selectable option;

and in response to receiving the user selection and the indication that the second item to be washed is removed from the dishwasher cavity, controlling, by the control device, the dishwasher by causing the dishwasher to execute the washing program from the number of washing programs for washing the first item to be washed and by activating by the aid of the number of aids of the dishwasher.

11. The method of claim 10, wherein the dishwasher is a household dishwasher.

* * * * *